United States Patent [19]

Heinrich et al.

[11] 3,991,549

[45] *Nov. 16, 1976

[54] FILAMENT YARN AND PROCESS TO PREPARE SAME

[75] Inventors: Karl Heinrich, Bobingen; Norbert Heichlinger, Konigsbrunn, both of Germany

[73] Assignee: Hoechst Aktiengesellschaft, Frankfurt am Main, Germany

[ * ] Notice: The portion of the term of this patent subsequent to Dec. 31, 1991, has been disclaimed.

[22] Filed: Sept. 27, 1974

[21] Appl. No.: 509,903

Related U.S. Application Data

[62] Division of Ser. No. 378,017, July 10, 1973, Pat. No. 3,857,252.

[30] Foreign Application Priority Data

Feb. 19, 1973 Germany ..... 2308138

[52] U.S. Cl. ..... 57/140 R; 57/140 BY

[51] Int. Cl.[2] ..... D02G 3/34

[58] Field of Search ..... 57/2, 140 R, 140 BY, 57/157 R, 157 F, 157 S, 157 TS

[56] References Cited

UNITED STATES PATENTS

| | | | |
|---|---|---|---|
| 3,001,358 | 9/1961 | Mayner | 57/2 X |
| 3,043,088 | 7/1962 | Breen | 57/157 F |
| 3,796,035 | 3/1974 | Watson | 57/140 BY |
| 3,831,360 | 8/1974 | Howath | 57/2 |
| 3,857,232 | 12/1974 | Heinrich et al. | 57/157 R |

*Primary Examiner*—Richard C. Queisser
*Assistant Examiner*—Charles Gorenstein
*Attorney, Agent, or Firm*—Connolly and Hutz

[57] ABSTRACT

The present invention concerns a process for preparing essentially smooth filament yarns having several loose filament ends stick out, wherein at least a portion of the used filaments has a flex abrasion resistance of below abt. 1 500 revol. and wherein a filament bonding is imparted in known manner to the filament yarns subject to this treatment and wherein same are then submitted to a transversal stress, at which occasion the filaments having a flex abrasion resistance of below 1 500 revol. break in irregular intervals and wherein the thus obtained loose filament ends of the filament yarns may, optionally, be temporarily interlaced by known methods so as to ameliorate the filament bonding and the filament yarns so obtained. These yarns are distinguished by excellent uniform characteristics all over their length and may be worked up to fabrics having an extremely low tendency to pilling.

2 Claims, 1 Drawing Figure

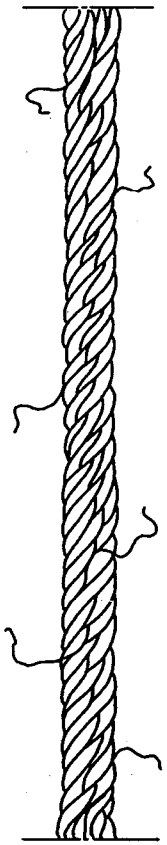

FILAMENT YARN AND PROCESS TO PREPARE SAME

This application is a divisional of application Ser. No. 378,017 filed July 10, 1973, now U.S. Pat. No. 3,857,252, issued Dec. 31, 1974.

Threads made of synthetic highpolymers normally come out of the production as smooth filament-threads, which, when being further processed, result in textile fabrics of an accordingly smooth surface lacking the usual soft touch and covering power of fabric surfaces made of spun fiber yarns. though attempts have been made to ameliorate these properties by texturizing the filament threads, same did not bring the results hoped for; obviously, it is of decisive importance, for evaluation of the texturized fabric surface, whether some fibers stick out of the fiber yarns.

The production of spun fiber yarns requires many processing steps, all of them implying a high portion of wage costs. Therefore, process methods have been developed which are supposed to enable the production of filament yarns having filament ends stick out, without having to take to cutting the synthetic filaments to staple fibers and to subsequent secondary spinning. The German Offenlegungsschrift 1660 606 describes a processing method for the production of such fluffy yarn, wherein the surface of drawn filament yarn is ripped and unraveled mechanically by rotating brushes. This process remains, however, limited to foamed thermoplastic polymers and, moreover, it is obviously applicable to coarse yarns only.

According to the British Pat. No. 924 086 it is said to be possible to draw simultaneously filaments of different stretchability in such way, that one of the components breaks and thus provides the loose ends as desired.

British Pat. No. 971 573 claims a similar process, jointly submitting two yarns of different elongation at break to a simultaneous drawing and texturizing process, whereby the stretching force applied has to be adjusted so as to break the yarn filaments with a lower elongation at break. This process provides bulk yarns with filament ends sticking out, which may be transformed by a subsequent processing step (stress while being exposed to temperature action) into crimpfree filament yarns with loose ends sticking out. This process is rather troublesome and, moreover, includes quite a series of drawbacks.

When drawing and texturizing treatments are arranged simultaneously, the drawing step is set at the beginning of the heater built into the false twist texturizing apparatus. Since this known treatment implies that part of the filaments breaks within the stretch area, the loose ends jam the twister of the texturizing apparatus again and again. A filament never breaks before being exposed to too high tensile stress. The passage, however, which immediately follows the break, is not picked up right away by the stretching godet, so that it remains unstretched or, at most, partially stretched over a certain length. An irregular stretch on one hand is the reason for an irregular dyestuff adsorption on the other hand and thus, of course, an uneven coloration of the woven or knitted fabrics made thereof is the result. Moreover, filament yarns prepared as per the state of the art, several filament ends of which stick out, show a strong tendency to pilling such as it is known from spun fiber yarns made of high polymers.

Therefore, it is object of the present invention to develop an operationally safe process for preparing nontexturized filament yarns, wherein the filaments of the yarn show uniform characteristics all over their length and may be worked up to fabrics having an extremely low tendency to pilling.

This problem could be solved by applying a transversal stress to the filament yarns consisting, at least partially, of filaments having a flex abrasion resistance of less than abt. 1 500 revolutions. Due to the transversal stresses applied to the yarn, the filaments with the reduced flex abrasion resistance break in irregular intervals. In order to simplify post-treatment, the obtained filament yarns may further be submitted to a subsequent treatment to ameliorate filament bonding.

For the production of the non-texturized filament yarns according to the invention, all filaments are appropriate consist, at least partially, of filaments having originally a folding and rubbing wear resistance of less than 1 500 revolutions, or the flex abrasion resistance of which may be brought down to this level by known methods. Best suitable are filaments the flex abrasion resistance of which is below 1000 revol., especially below 500 revol. The value of the flex abrasion resistance influences the number of loose filament ends produced by the process according to the invention, whereby the filaments having the lower flex abrasion resistance break easier under the transversal stress. On the other hand, the number of loose filament ends may also be influenced by the portion within the total filament yarn of filaments having a lower flex abrasion resistance. The more the flex abrasion resistance of woven and knitted materials is reduced, the less they show a tendency to pilling. However, as the term of "flex abrasion resistance" already implies, it is normally impossible to produce or utilize practically useful filament yarns having a folding and rubbing wear resistance of e.g. zero. However, in special cases requiring woven or knitted fabrics of particularly low tendency to pilling, filaments having flex abrasion resistance values of e.g. less than 5 revol. may be used:

The flex abrasion resistance is measured by means of the flex abrasion device such as it is described e.g. by grunewald in Chemiefasern 12 (1962), pg. 853. By "revol", i.e. revolutions, as used herein with reference to flex abrasion resistance is meant cycles. This is clearly understood to one skilled in the art, and also from the property of flex abrasion resistance in connection with which the term is used as well as from the device employed in measuring said property as described in said publication just cited in this paragraph. Filaments having a reduced flex abrasion resistance and, nevertheless, a good linear strength (longitudinal sense of the fiber) may be obtained from high polymers, e.g. by use of polymerizates having a sufficiently low molecular weight, as example be cited here the products according to Deutsche Auslegeschrift 1 278 688. For filaments made of polyethylene-terephthalate the following values could be found concerning flex abrasion resistance and concerning the average molecular weight:

An average flex abrasion resistance of abt. 1 500 revolutions is linked to an average molecular weight of abt. 12 500, whilst flex abrasion resistance values below 10 revol. may be linked to average molecular weights of abt. 8000.

Polyethylene-terephthalate filaments of so low a molecular weight cannot be melt-spun on an economically reasonable basis due to the low fusion viscosity of the polymers; they may, however, be prepared e.g. of the polymers as per Deutsche Auslegeschrift 1237 727, Deutsche Auslegeschrift 1273 123 or Deutsche Auslegeschrift 1720647. Threads of linear polymers which may partially be treated in a permanently cross-linked fashion can as well have a reduced flex abrasion resistance. Therefore, same are also well suitable for being processed according to the invention, within the said ranges of flex abrasion resistance values. It depends on the use intended, whether all the filaments of the filament yarn may have the desired low flex abrasion resistance of less than 1 500 revol. and thus produce loose filament ends or whether only a portion of the filaments has this property while the rests shows a high flex abrasion resistance and, therefore, does not break during exposure to transversal stress. In order to attain a sufficient yarn strength, slightly tighter interlacing of the filaments has to be chosen in the first case, whilst in the latter case sufficient yarn strength is guaranteed anyway by the filaments. Filament yarns blended at 7:3 to 3:7 of filaments having a lower flex abrasion resistance (below 1 500 revol.) with filaments, resistance of which exceeds 1 500 (e.g. 3000 revol.), resulted in knitted or woven fabric which excels in especially attractive appearance and touch of the product and by excellent wear as well. Furthermore, titer, profile and number of the filaments, i.e. the total titer of the filament yarn used, may be determined freely as best they suit the use in mind. Most often the titer will remain within the range of from 1 to 15 dtex per filament and of below 300 dtex for the yarn, usually set for textile application purposes; however, special purposes such as decorative fabric may also require higher titers. In case that different filaments are used to make up a yarn, their titers and cross sections may differ as well, of course; filaments may also consist of diverse raw materials so that their diversified characteristics may contribute to realize further special effects, such as those caused by use of mixture yarns or coloured twist yarns due to the fact that the different components absorb the applied dyestuff differently; the flame resistance may be increased by using yarn components which are flame-proof or flame-retarding; yarns of a potential crimp effect may be prepared by using bicomponent threads or filaments of different shrinkage. On the other hand it is also possible, of course, to modify conveniently the dyeing reaction of the filaments so as to adapt same to enable uniform colorations. Since in the process according to the invention the filaments are regularly drawn before breaking, a uniform coloration all over their total length including the loose ends is guaranteed, differing from known processing methods wherein overstretching causes the break of the filaments while drawing same.

A preferred embodiment of the invention is represented by essentially smooth filament yarns consisting of component mixtures showing individually diversified titers and where the yarn component of the lowest individual titer provides the loose filament ends sticking out of the yarn.

It is generally useful to mix the individual components while processing various filaments into a filament yarn. Mixing may take place at anyone of the different preceding processing stages. For instance, the two kinds of filaments may be spun either from one single spinning nozzle or from two adjacent spinning nozzles as described — for example — in British Pat. No. 1 208 801. A particularly simple mixing method is to ply the different yarn components before drawing.

The application of a transversal stress to the filament yarns, necessary according to the invention for preparing crimp-free filament yarns with individual loose ends, may be realized, for example, by twisting the filament yarns. Depending on the applied torsion per length unit, a larger or smaller number of threads are breaking in the filament yarns according to the invention. Thus it is possible to prepare these yarns, for instance, by using regular draw-twist devices. Another form of transversal stress is to move the filament yarns to be treated around a thread guide having a small diameter. When chosing this form of the process according to the invention, it is very important to make sure that the processing conditions are set in such a way that overstretching at the thread guide devices and crimping of the thus treated threads be prevented. It is also possible to apply a combination of these two embodiments of transversal stress.

Though the filaments with a lower flex abrasion resistance break in irregular intervals under application of transversal stress, the loose filament ends stick out of the filament yarn in a regular, not in a periodical distribution all over its length. Contradictory to the aforesaid, the hitherto known methods for preparing filament yarns with loose ends, breaking the filaments by overstretching during the drawing process, very easily produced a simultaneous break of numerous filaments and thus lead — at least — to an irregular accumulation of loose filament ends.

For the execution of the process according to the invention all such filament yarns may be used, that consist — at least partially — of filaments having a flex abrasion resistance below 1 500 revol. These yarns may comprise e.g. highmolecular polyamides, polyesters, polyolefins, polyacryl-nitriles, cellulose or thread-forming copolymers or derivatives of these materials.

The filaments used should be drawn evenly and thoroughly before applying the transversal stress according to the invention for producing the individual loose filament ends. In order to prevent processing difficulties, it is necessary that the filament yarns used do not show yet any broken single filaments immediately after being drawn. The real transversal stress should not be applied before filament bonding has increased sufficiently so as to avoid sliding open of the broken ends. A particularly simple process is twisting the filaments e.g. by means of a ring twister. A torsion is here applied to the filament yarn as it is usually done for fiber yarns. This twist is at the same time sufficient as transversal stress for breaking the individual filaments with a reduced flex abrasion resistance. The lower limit of the twist required (in revol./m) for still producing a yarn according to the invention, depends as well on the flex abrasion resistance of the yarns or yarn components used as of their titer, too and may be easily determined in each case by pre-testing. However, to increase the filament bonding other known methods are also applicable, such as interlacing in a gas jet or exposure to electrostatic forces, whereby the necessary transversal stress may then be built up by moving the filaments around a thread guide having a small diameter. If desired, combinations are possible of the different treatments for increasing filament bonding and of said methods for applying transversal stress.

After the transversal stress succeeded in producing broken filament ends, these still stick out more or less, depending on the degree of filament bonding chosen. In order to facilitate the further processing of the yarn, its running properties may, optionally, be ameliorated either by application of an additional preparation coating or sizing product. If desired, other known methods may as well be applied to increase filament bonding.

When being submitted to further treatment, the crimp-free filament yarns with loose filament ends prepared as per the process of the invention excel in the unusual levelness of textile-technological properties displayed all over the length of these yarns. In comparison to filament yarns composed of continuous filaments, the afore described yarns have a greater covering power and a finer hand, though their volume did not increase substantially. Surfaces formed by the filament yarns according to the invention display properties which place them between these made of smooth filament yarns on one hand and those made of staple fiber yarns on the other hand. They are especially well appropriate for plain fabrics, such as cambriclike ones. Compared to known knitted and woven fabrics of fiber yarns, those made of the filament yarns according to the invention are outstanding by their low tendency to pilling. The fundamental structure of the yarns according to the invention is explained by the drawing.

Though the development of so-called low-pilling fiber types succeeded in reducing to an acceptable degree (cf. in this respect "P. Braun, Chemiefaser/Textilindustrie 1972, pg, 537 – 540"), the known high tendency to pilling to which fabrics are prone formed by spun fiber yarns of synthetic polymers, it has been found, surprisingly, that the yarns as per the invention — comparably twisted — can be worked up to fabrics, the tendency to pilling of which does not even attain the degree stated for the least pilling spun fiber yarns known to the art. The tendency to pilling of specific fabrics was examined by the Random Tumble Pilling Tester (cf. e.g. Baird, Legere, Stanley, in Textile Research Journal 26 (1956), pg. 731 and ASTM Standards on textile materials 1961, pg. 552). The tendency to pilling is evaluated visually by applications of "the Reutlinger pill grades" (snyopsis cf. e.g. Grunewald in Chemiefasern (12) 1968, pg. 936).

The flex abrasion resistance was defined, as said before, by means of a flex abrasion device, whereby the filaments to be examined are subject to a transversal stress of 0,45 g/dtex, the diameter of the wire being from 0,02 mm to 6,7 dtex, 0,04 mm to 13 dtex and 0,05 mm for even higher titers, folding occurs in an angle of 110° at a velocity of 126 revol./min.

The following examples illustrate the invention:

EXAMPLE

A filament yarn with individual loose filament ends was prepared according to the process of the invention as a blended yarn composed of 12 filaments having the titer dtex 5,5 (yarn component dtex 67 f 12) and of 40 filaments having the titer dtex 1,7 (yarn component dtex 67 f 40).

The yarn component 67 f 12consisted of a polyethylene terephthalate of the relative viscosity $\eta_{rel} = 1{,}81$ (measured by a solution of 1 g in 100 ml of a mixture of phenol-tetrachlorethane, weight proportion 3:2 at 25° C). The spinning temperature amounted to 290° C, at a melt output of 35,5 g/min, the take-up rolls were fed at a speed of 2 400 m/min.

The polymer material for the yarn component 67 f 40 was prepared in adaptation to the details given by example 1 of Deutsche Auslegeschrift 1 720 647, however, the 2,4 g of zinc acetate were replaced by 3,1 g of manganese acetate and the portion of trimethoxysilanethane phosphonic acid diethyl ester was increased from 48 g to 72 g. The melt temperature during the spinning process amounted to 290° C, the melt output was by 32,5 g/min, take-up speed 2·200 m/min.

Bobbins of each of the two yarn components were linked to a draw-twister with ring traveler and jointly drawn at a stretch-proportion of 1:2,2 over a pin heated to 100° C and an adjacent heater plate having a temperature of 165° C. The two yarn components were plyed on the draw-twister, the blended yarn thus obtained had a torsion of 20 revol./m, no loose ends sticking out could be observed.

A separate measuring of the textile values showed a strength of 36,5 g/tex at an elongation of 27 % for dtex 67 f 12 and a flex abrasion resistance of abt. 3 800 revol., whilst the yarn component 67 f 40 showed a strength of 27 g/tex at 32 % elongation and a flex abrasion resistance of 415 revol.

Subsequently, the blended yarn was fed into a multiple twisting machine. At the thread entrance a contact heater plate was placed having a surface temperature of 210° C and a length of 70 cm. At a feed-in speed of 8,7 m/min and spindle revolutions of abt. 13 000 r/min a twist of 1 500 r/meter was imparted to the yarn, presenting an average of one filament end per cm of yarn length. When reducing the torque to 1000 r/meter a loose filament stuck out abt. every 2 to 3 cm only.

When testing in the Random Tumble Pilling Tester woven and knitted fabrics made of this filament yarn, not later than after a testing period of 2 hours the value zero was hit, i.e. at the end of this test the surfaces of the fabrics did not show the least modifications.

We claim:

1. An essentially smooth filament yarn with several loose filament ends sticking out, which have a flex abrasion resistance of less than 1500 cycles.

2. An essentially smooth filament yarn according to claim 1 wherein said yarn comprises fiber-forming highpolymer polyethylene-terephthalates with several loose filament ends sticking out.

* * * * *